US005682644A

United States Patent [19]

Bohacik et al.

[11] Patent Number: 5,682,644

[45] Date of Patent: Nov. 4, 1997

[54] HINGE ASSEMBLY

[75] Inventors: Richard Bohacik, Lanoka Harbor, N.J.; Bernard Parisi, Barnegat, N.J.

[73] Assignee: Component Hardware Group, Inc., Lakewood, N.J.

[21] Appl. No.: 595,926

[22] Filed: Feb. 6, 1996

[51] Int. Cl.[6] ..... E05F 1/08

[52] U.S. Cl. ..... 16/284; 16/303

[58] Field of Search ..... 16/278, 303, 312, 16/314, 315, 318, 284

[56] References Cited

U.S. PATENT DOCUMENTS

| | | | |
|---|---|---|---|
| 165,619 | 7/1875 | Sanderson | 16/318 |
| 879,542 | 2/1908 | Hartman | 16/318 |
| 3,063,089 | 11/1962 | Greenman | 16/303 |
| 3,518,716 | 7/1970 | Larson | 16/284 |
| 3,975,794 | 8/1976 | Kaiser | 16/303 |
| 4,215,449 | 8/1980 | Loikitz | 16/303 |
| 5,138,743 | 8/1992 | Hoffman | 16/303 |

*Primary Examiner*—Daniel W. Howell
*Assistant Examiner*—Donald M. Gurley
*Attorney, Agent, or Firm*—McAulay Fisher Nissen Goldberg & Kiel, LLP

[57] ABSTRACT

The self-closing hinge assembly has a pair of cam members which are biased against each other by a pair of coil springs. The outer coil spring serves to bias the cam members together under a first restoring force and is effective during an initial opening of a door, for example to a 90° position. The second inner spring becomes compressed only after the outer coil spring has been compressed. Compression of the second coil spring occurs as a door is opened beyond the 90° position. The door may be held in one of two dwell positions corresponding to the cam surfaces on the movable cam member.

24 Claims, 3 Drawing Sheets

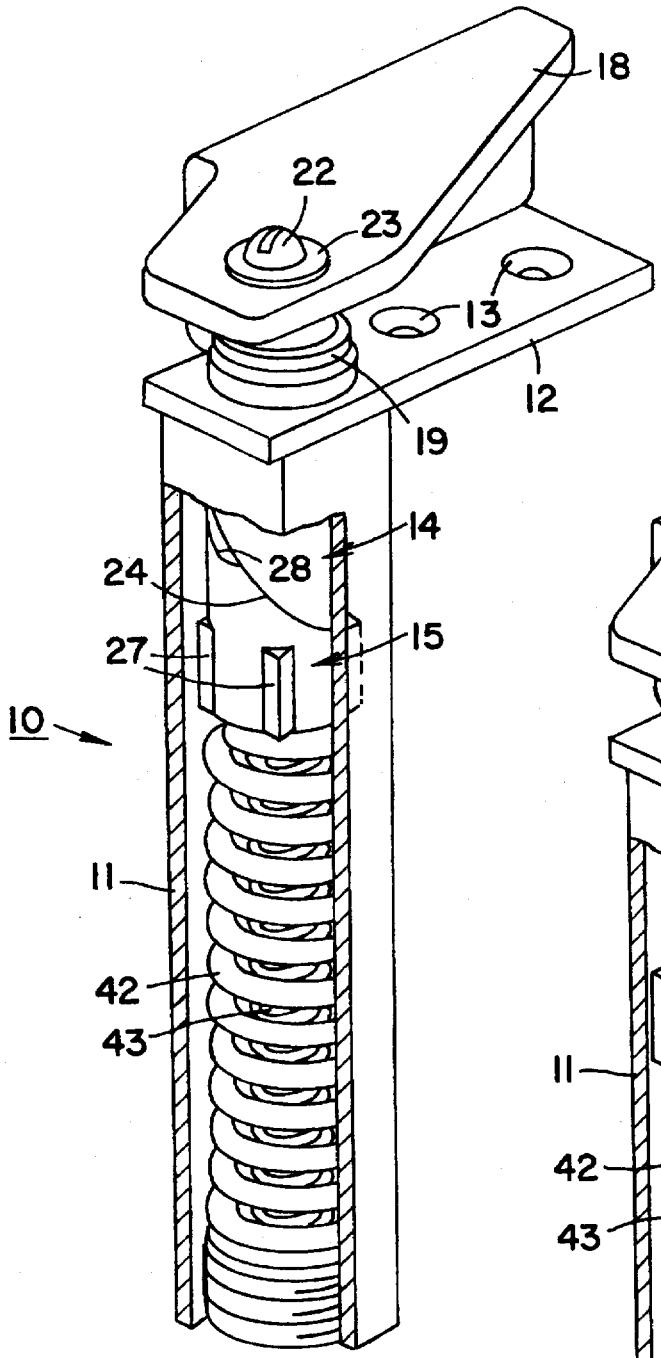
FIG. 1
FIG. 2
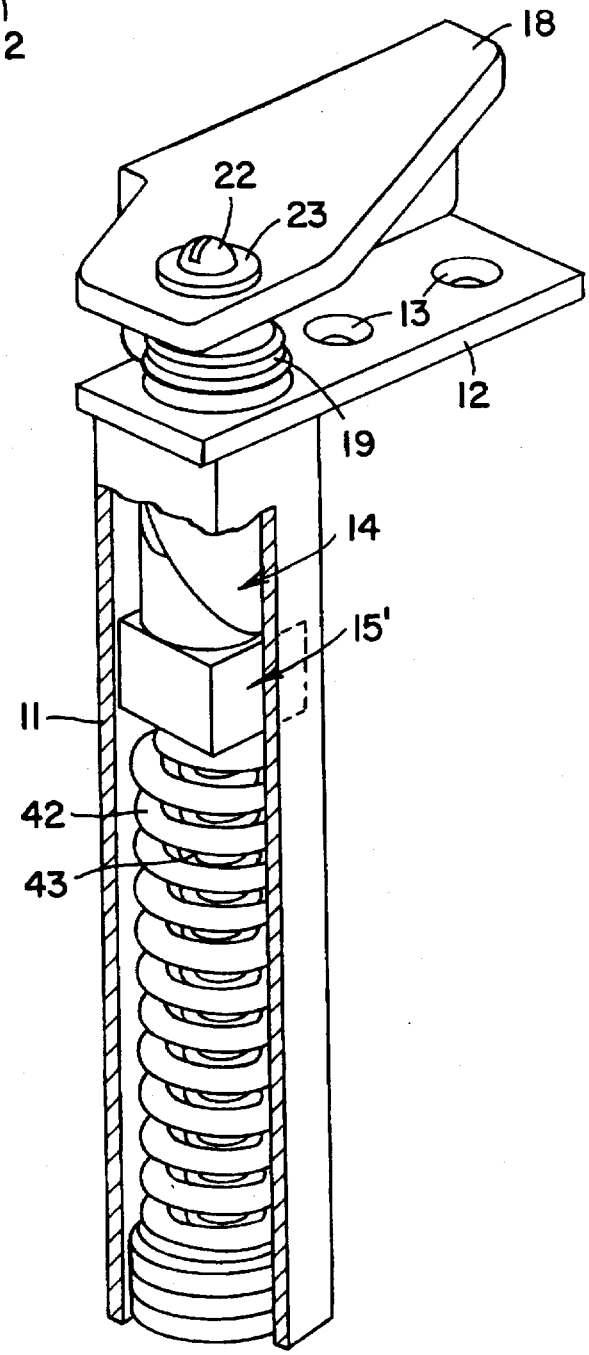

FIG. 5
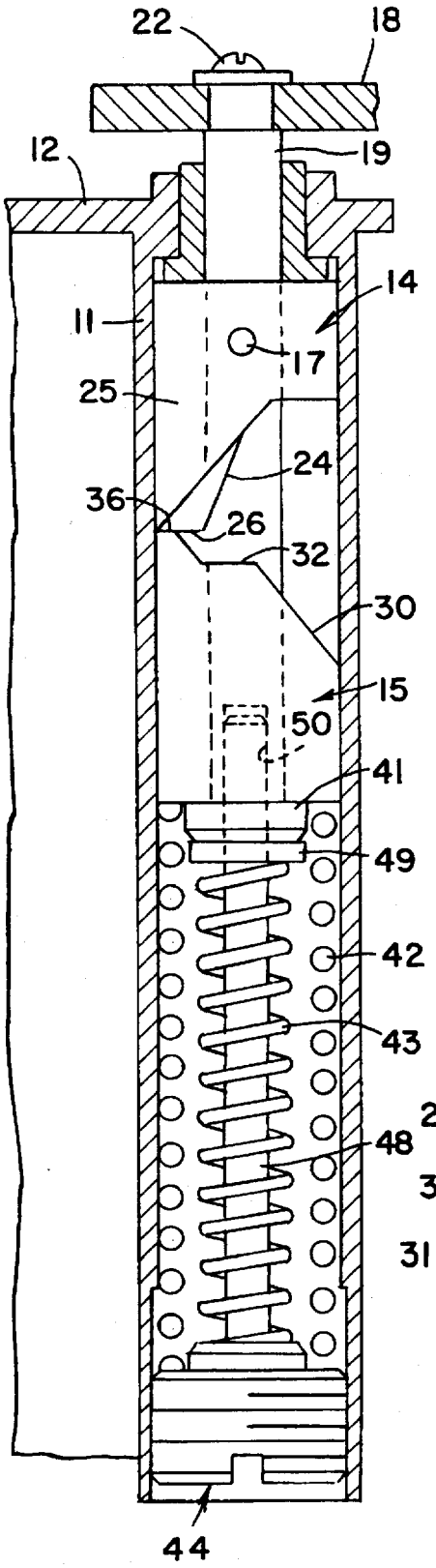
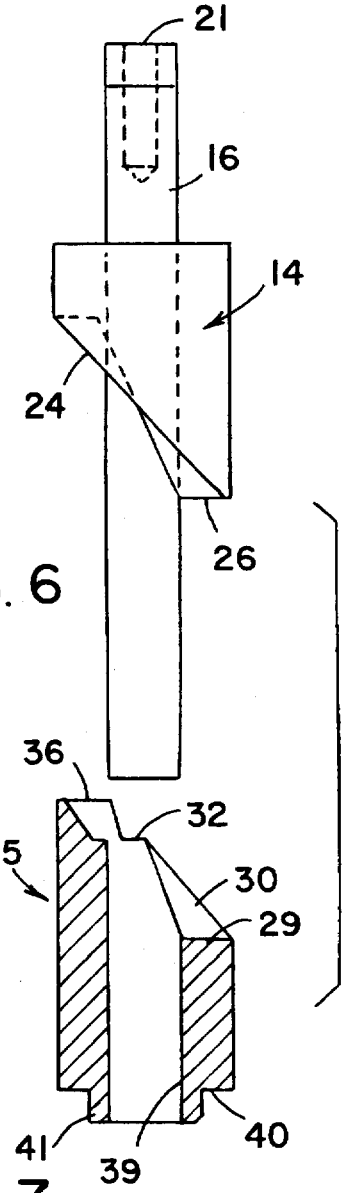
FIG. 6
FIG. 7
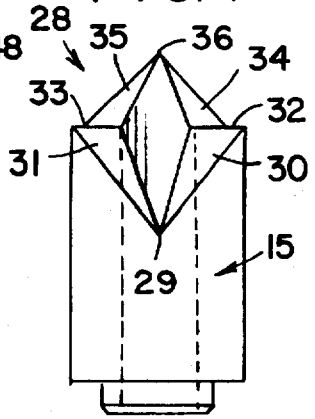
FIG. 8
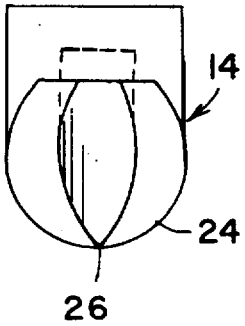

HINGE ASSEMBLY

This invention relates to a hinge assembly. More particularly, this invention relates to a self closing hinge assembly. Still more particularly, this invention relates to a self-closing hinge assembly for a door of a cabinet.

As is known, various types of hinges have been employed for doors, gates and the like. In some cases, the hinges have been constructed in a relatively simple manner such as described in U.S. Pat. No. 3,602,942 wherein a pair of leaves are mounted on a common hinge pin. In such hinges, one leaf is usually secured to a stationary member while the other leaf is secured to a movable member. Other types of hinge assemblies have also been known which are of a self-closing type so as to cause a movable element, such as a door, to swing to a closed position after being opened. Such hinge assemblies are described in U.S. Pat. Nos. 2,538,679 and 3,518,716.

Still other types of hinge assemblies have been known, such as described in U.S. Pat. No. 3,537,126, for use with swing doors which employ two springs of different strengths so that one spring is used to urge the door in a closing direction while the other spring is used to urge the door in a opening direction. The springs are designed so that the tendency to close the door is greater than the tendency to open the door.

Still another hinge assembly is described in U.S. Pat. No. 4,215,449 in which a self-closing hinge assembly employs a U-shaped clip to prevent a door from opening beyond a certain extent. However, in some cases should the door be extended beyond the point intended, the U-shaped clip runs a risk of breaking or otherwise being propelled from a secure position within the hinge assembly thereby creating a risk of injury to a person opening the door. Further, such hinge assemblies cannot be readily adjusted should a need arise to increase or decrease the desired force for returning a door to a closed position. Another problem that occurs is that after several cycles, the U-shaped clips tend to weaken and not function properly. That is, the clips do not exert sufficient pressure to cause a reclosing of a door.

Still further, the previously known hinge assemblies usually only permit a door to be opened to a particular point and then be returned from that point to a closed position. Thus, should a user decide to open the door to a greater extent, the door must be held manually in the opened position against the bias of the spring.

Accordingly, it is an object of the invention to provide a hinge assembly which has multiple positions at which a door can be automatically held in an opened position.

It is another object of the invention to provide a hinge assembly having an improved spring action to keep a door closed and sealed.

It is another object of the invention to be able to adjust the spring pressure of a spring loaded self-closing hinge assembly.

Briefly, the invention provides a hinge assembly which includes an elongated housing, a pair of cam members within the housing and at least one spring means in the housing for biasing the cam members toward each other.

One cam member is disposed in the housing for rotation relative to the housing and includes a pin which extends from one end of the housing for securement to a bracket which, in turn, can be mounted in a stationary frame, such as a cabinet or the like. This cam member aim has a cam surface at an end opposite the pin end.

The second cam member is also disposed in the housing but in fixed relation thereto for rotation with the housing relative to the first cam member. This second cam member also has a cam surface facing the cam surface of first cam member.

The spring means is disposed in the housing and is located between one end of the housing and the second cam member for biasing the second cam member against the first cam member in order to mutually engage the two cam surfaces with each other.

Typically, the housing is secured to a door which is to move relative to the stationary frame. In these cases, the first cam member remains stationary while the second cam member rotates with the housing of the hinge assembly. The cam surfaces of the two cam members are arranged so that during relative rotation, the second cam member moves coaxially away from the first cam member, for example downwardly against the force of the coil spring.

In accordance with the invention, the hinge assembly employs an abutment means in the housing at one end for abutting the spring means as well as a second spring means in the housing coaxially within the first spring means. The second spring means is disposed against the abutment means at one end and is spaced from the second cam member at the opposite end. This second spring means is compressed by the second cam member only after the second cam member has moved over a predetermined distance while causing a predetermined compression of the other spring means. For example, the point at which the cam member first abuts the second spring means may correspond to an angle of rotation of 90° between the housing and the first cam member, i.e. between the door and frame. Thus, a greater force is required in order to open the door beyond that point. At the same time, the restoring force on the door is greater once the door has been opened by more than 90°.

In accordance with the invention, the cam surface of the second cam member, i.e. the axially movable cam member, has an annular shape with a first point corresponding to a closed position of the cam members relative to each other, a first inclined portion extending from this point and a first flat portion corresponding to a first dwell position of the cam members relative to each other. This is followed by a second inclined portion and a second flat portion which corresponds to a second dwell position of the cam members relative to each other. By way of example, the first flat portion is arcuately spaced from the first point a distance of 90° while the second flat portion is arcuately spaced from the first point a distance of 135°.

The cam surfaces may be made symmetrical so that the hinge assembly can be used at the top of a frame or at the bottom of a frame.

In use, a user may open a door to the first dwell position in order to gain access to a cabinet. In this way, the hands of the user may be free for moving materials into or out of the cabinet. During this time, the door remains in the open position. Should the user desire to obtain greater access to the cabinet, the door is opened to the second dwell position of the hinge assembly. The door would then remain in the second dwell position until actuated to return to the closed position.

Should the door be inadvertently opened to an angle of more than 180° relative to the cabinet, there is little or no risk of overstressing of the springs means within the housing as the spring means are not compressed any further. If the door were swung, e.g. to a 270° position, the door would be biased in a direction opposite to the closing direction. This would then require the user to manually grasp the door and to swing the door towards the closed position.

One advantage of the adjustability of the abutment means is that the abutment means may be movable longitudinally of the housing of the hinge assembly to compress the first coil spring more or less relative to a given initial position. In this way, the hinge assembly can be calibrated upon manufacture for a given return force.

These and other objects and advantages of the invention will become more apparent from the following detailed description taken in conjunction with the accompanying drawings wherein:

FIG. 1 illustrates a part-exploded perspective view of a hinge assembly constructed in accordance with the invention;

FIG. 2 illustrates a view similar to FIG. 1 of a modified hinge assembly in accordance with the invention;

FIG. 5 illustrates a cross-sectional view of the hinge assembly of FIGS. 1 and 3 in a second dwell position in accordance with the invention;

FIG. 6 illustrates an exploded view of the two cam members constructed in accordance with the invention;

FIG. 7 illustrates a view of the lower cam member; and

FIG. 8 illustrates a side view of the upper cam member of FIG. 7.

Referring to FIG. 1, the hinge assembly is of a spring-loaded self-closing type. In particular, the hinge assembly 10 is constructed so as to be secured to a door or the like for hingeably securing the door relative to a frame, such as a cabinet.

The hinge assembly 10 includes an elongated housing 11 of hollow rectangular cross-sectional shape from which an integral flange 12 extends at one end at a right angle to the housing axis. As indicated, the flange 12 has a pair of recessed apertures 13 therein for receiving suitable bolts or screws to permit the flange 12 to be secured to a door (not shown). Typically, the housing 11 and flange 12 are made of metal.

Figure 3:
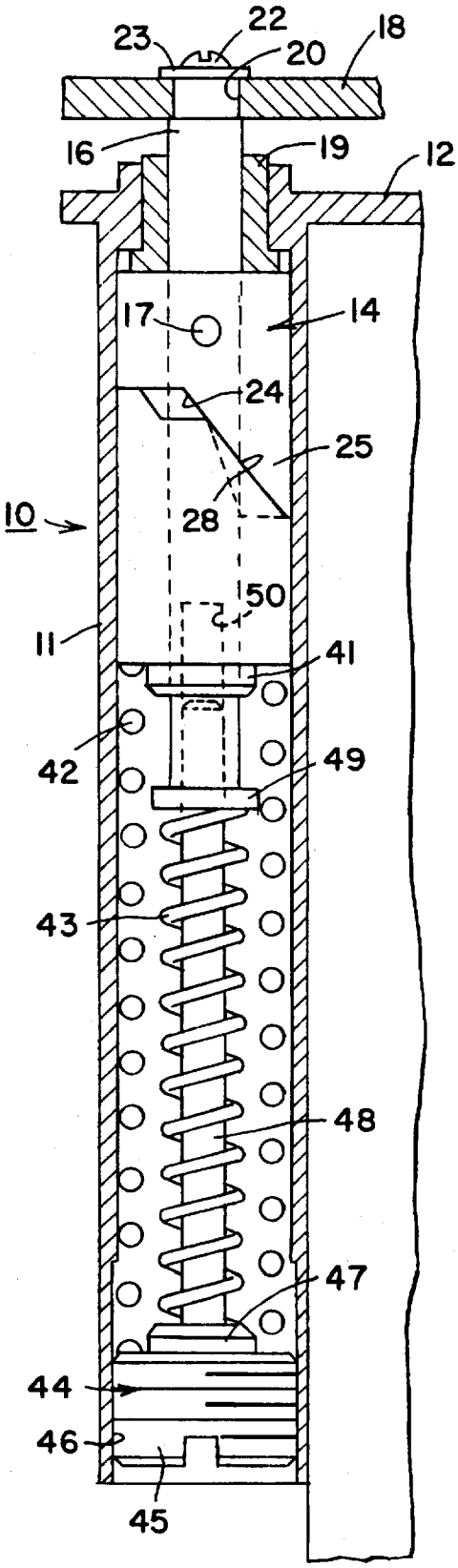
FIG. 3 illustrates a cross-sectional view of the hinge assembly of FIG. 1 in a closed position in accordance with the invention.

The hinge assembly 10 also has a pair of cam members 14, 15 disposed within the housing 11. As indicated in FIG. 3, the upper cam member 14 is of a shape, for example of a cylindrical shape, to rotate relative to the housing 11. In addition, the cam member 14, is mounted on a pin 16 and is secured thereto by a dowel pin 17 or the like. The pin 16, in turn, extends upwardly through and from one end of the housing 11 for securement to a bracket 18. The cam member 14 may alternatively be made of one piece. As indicated in FIG. 3, the pin 16 passes through a bushing 19 or the like seated in the upper end of the housing 11. Typically, the bushing 19 is made of a plastic material suitable to function as a bearing to permit rotation of the pin 16 relative to the housing 11. The pin 16 also has a reduced portion which passes through an opening 20 in the bracket 18 as well as a threaded bore 21 (see FIG. 6) for receiving a screw 22. As indicated in FIGS. 1 and 3, the screw 22 abuts against a washer 23 to secure the pin 16 to the bracket 18.

Referring to FIG. 1, the bracket 18 is of any suitable shape and construction and is typically secured to a frame (not shown) such as a cabinet, refrigerator frame or the like.

The cam member 14 also has an annular cam surface 24 at the lower end, that is, the end opposite the pin end (see FIG. 8). In addition, the cam member 14 is shaped to provide a depending lobe 25 (see FIG. 4) which defines a punctiform edge 25 at the lowermost end.

The second cam member 15 is slidably mounted within the housing 11 so as to be held in fixed relation thereto for rotation with the housing 11 relative to the upper cam member 14. As indicated in FIG. 1, the lower cam member 15 has a plurality (i.e. four) of projections 27 of triangular cross-sectional shape for fitting into the corners defined by the walls of the housing 11. Alternatively, as shown in FIG. 2 wherein like reference characters indicate like parts as above, the lower portion of the cam member 15' may be of a mating shape to the interior of the housing 11, i.e. being of a rectangular cross-sectional shape to prevent relative rotation.

Referring to FIGS. 1 and 3, the lower cam member 15 has a cam surface 28 facing the cam surface 24 of the upper cam member 14. This cam surface 28 is more particularly shown in FIGS. 6 and 7.

As indicated in FIGS. 6 and 7, the cam surface 28 has an annular shape with a first point 29 corresponding to a closed position of the cam members relative to each other (FIGS. 1 and 3) and two inclined portions 30, 31 which extend from this point 29 in opposite directions relative to a horizontal plane. These inclined portions 30, 31 mate with corresponding inclined portions on the cam surface 24 of the upper cam member 14 (see FIG. 3) in the closed position. In addition, the cam surface 28 includes a pair of flat horizontal portions 32, 33 (as viewed) which are diametrically opposed to each other to define a dwell position of the cam members 14, 15 relative to each other. As indicated in FIG. 7, each respective flat horizontal portion 32, 33 extends from a respective inclined portion 30, 31.

The cam surface 28 also has a second pair of inclined portions 34, 35 which extend from the flat portions 32, 33 to a flat portion 36 located therebetween. As indicated in FIG. 7, each of the second inclined portions 34, 35 extend from a respective flat portion 32, 33 and terminates at the uppermost flat portion 36. The uppermost flat portion 36 (see FIG. 6) corresponds to a further dwell position of the cam members 14, 15 relative to each other.

By way of example, each of the first flat portions 32, 33 is arcuately spaced from the first point 29 to begin at a distance in the range of 60° to 95° while the uppermost flat portion 36 begins at a point arcuately spaced from the first point 29 at a distance in the range of 90° to 135°.

As indicated in FIGS. 7 and 8, the cam surfaces 24, 28 are symmetrical so that the hinge assembly 10 can be used at the top of a frame or at the bottom of a frame.

Referring to FIG. 6, the lower cam member 15 has a central bore 39 which slidably receives a depending portion of the pin 16. In addition, the lower end of the cam member 15 has a flat surface 40 for purposes as explained below and has a central portion which extends beyond the flat surface 40 to define a cap 41 for purposes as described below.

As shown in FIG. 1, the hinge assembly 10 has a pair of springs means 42, 43 which are coaxially disposed within the housing 11. As shown in FIG. 3, the outer spring means 42 in the form of a coil spring which abuts the flat surface 40 of the lower cam member 15 while the opposite end abuts against an abutment means 44 at the lower end of the housing 11. As indicated, the abutment means 44 includes a screw threaded portion 45 of cylindrical shape which threads into an internal thread 46 at the lower end of the housing 11 and an integral pin portion which defines a cap 47 adjacent the threaded portion and an upstanding pin 48 of reduced diameter.

The internal thread 46 of the housing 11 is formed on a diameter which is larger than the cross-sectional width of the interior of the housing 11 in order to permit the cam members 14, 15 to be slid into place through the open end of the housing 11 during assembly without interference from the thread 46. Also, the lower end of the housing 11 has longitudinal slots (not shown) formed in the otherwise circular internal screw thread 46 to interrupt the thread 46 into arcuate segments to permit passage of the projections 27 (FIG. 1) on the lower cam member 15. However, any other suitable form of interruption may be provided in the otherwise circular pattern of the screw thread 46 to permit passage of the cam member 15.

Figure 4:
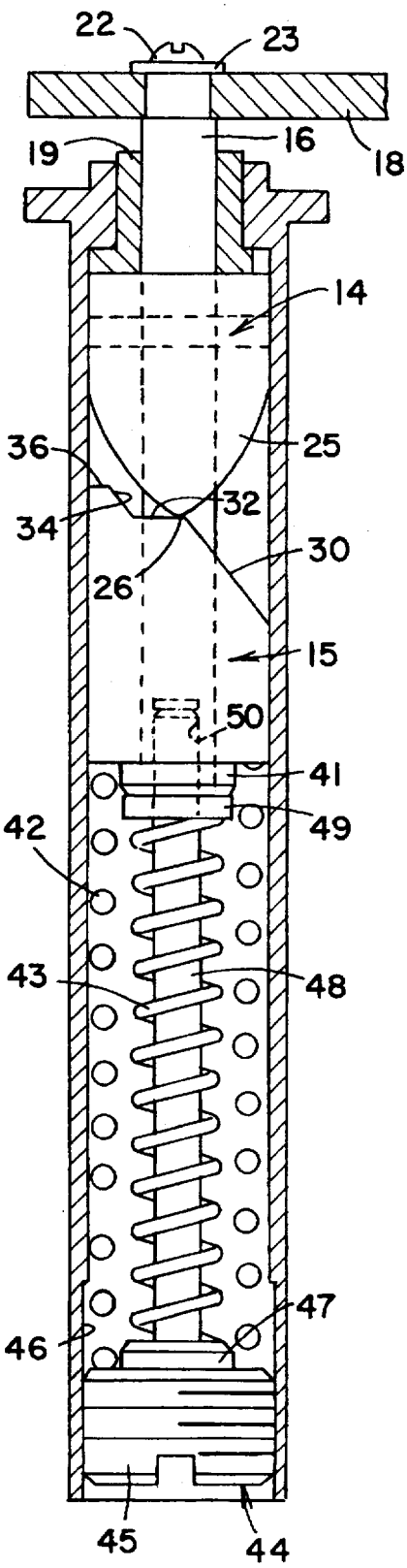
FIG. 4 illustrates a cross-sectional view of the hinge assembly of FIGS. 1 and 3 in a first dwell position.

The coil spring 42 is of a sufficient strength to bias the lower cam member 15 against the upper cam member 14 while also permitting the cam members 14, 15 to rotate relative to each other while compressing the spring 42 as indicated in FIG. 4.

The inner spring means 43 is in the form of a coil spring mounted within the outer coil spring 42 and is of a shorter length. In addition, the inner coil spring 43 is mounted about the guide pin 48 to rest against the cap 47 of the abutment means 44. A washer 49 is also disposed about the guide pin 48 so that the coil spring 43 is disposed between the cap 47 at one end and the washer 49 at the upper end.

The pin 48 is of a length to extend into a counterbore 50 in the lower end of the pin 16 passing through the upper cam member 14. For example, in the closed position of the cam members 14, 15 shown in FIG. 3, the guide pin 48 extends partway into the bore 50 of the pin 16. Sufficient clearance is provided so that the guide pin 48 may slide further into the counterbore 50 when the cam members 14, 15 are in a partially opened position corresponding to the first dwell position as shown in FIG. 4. At this time, the washer 49 abuts the cap 41 of the lower cam member 15 while the guide pin 48 is closely spaced from or abuts the bottom of the counterbore 50.

Thus, the inner coil spring 43 is disposed against the abutment means 44 at the lower end while being spaced from the lower cam member 15 at the opposite end. The inner coil spring 43 is thus compressed by the lower cam member 15 only after the cam member 15 has moved over a predetermined distance while causing a predetermined compression of the outer coil spring 42, that is from the position shown in FIG. 3 (the door-closed position) to the position shown in FIG. 4, i.e. the first dwell position (the door-partially opened position).

Each spring means 42, 43 may alternatively be formed by a stack of wave springs, a spiral wave spring or a stack of Bellville washers.

Referring to FIG. 3, fabrication of the hinge assembly 10 proceeds, for example, as follows.

First, the upper cam member 14 is slid onto the pin 16 and secured in place by the dowel pin 17 unless the cam member 14 and pin 16 are otherwise made in one piece. Next, the lower cam member 15 is slid onto the pin 16 (see FIG. 6).

The two springs 42, 43 are then disposed coaxially about the guide pin 48 of the abutment means 44 and the washer 49 is slid over the free end of the guide pin 48 to abut the inner coil spring 43. The resulting two units are then brought together with the guide pin 48 of the one unit sliding into the counterbore 50 of the pin 16 secured to the upper cam member 14 of the other unit. At the same time, the lower end of the pin 16 abuts the washer 49 as indicated in FIG. 3. The bushing 19 is then placed over the upper end of the pin 16 and the resulting cartridge is then slid into the housing 11. At this time, the projections 27 on the lower cam member 15 pass through the interruptions provided in the internal thread 46 at the lower end of the housing 11. Thereafter, the threaded portion of the abutment means 44 is threaded into the internal thread 46 of the housing 11 to a point to provide a desired compression of the outer coil spring 42 and thereby effect a predetermined bias of the lower cam member 15 against the upper cam member 14.

Alternatively, other modifications may be made in the various steps of fabrication as desired.

Once the desired compression of the outer coil spring 42 has taken place, the abutment means 44 may be permanently fixed in any suitable manner. For example, the housing 11 may be staked to secure the abutment means 44 in place. The resulting hinge assembly 10 can now be mounted on a door by a fabricator or ultimate consumer. That is to say, the flange 12 of the housing 11 is mounted on the door in a conventional manner by means of a pair of screws or bolts passing through the apertures 13 and the flange (see FIG. 1). The projecting end of the pin 16 can then be inserted through the aperture 20 in the bracket 18 and the washer 23 and screw 22 put into place to fix the pin 16 to the bracket 18 and, thus, to the frame on which the bracket 18 is mounted.

Once the hinge assembly 10 has been mounted in place, a user may swing the door relative to the frame into a partially opened position with the hinge assembly 10 moving into the first dwell position indicated in FIG. 4, for example, to a position where the door has been rotated 90° about the axis of the pin 16. During this time, the upper cam member 14 remains stationary relative to the housing 11 since the cam member 14 has become secured to the bracket 18 via the screw 22. As a result, the rotation of the lower cam member 15 with the housing 11 causes the lower cam member 15 to ride over the depending lobe 25 of the upper cam member 14. During this time, the edge 26 of the lobe 25 slides over an inclined surface, e.g. the inclined surface 30, of the lower cam member 15. In this respect, rotation of the housing 11 is considered to be in a clockwise direction relative to FIG. 1.

As the lobe edge 26 slides along the surface 30, the lower cam member 15 is moved downwardly compressing the outer coil spring 42. This action continues until the lobe edge 26 slides onto the flat surface 32 (see FIG. 4). The cam members 14, 15 thus move into a first dwell position with the door coming to a stop. Of note, the flat surface 32 is of an extent to allow a slight movement of the door, e.g. of about 5° to 10°. The following inclined surface 34 provides an abutment by means of which continued motion of the door will be arrested unless there is a conscious effort on the part of the user to open the door to a further point.

When the lower cam member 15 reaches the first dwell position, the outer spring 42 has been compressed into the condition indicated in FIG. 4 so that the cap 41 moves into contact with the washer 49 abutting the inner coil spring 43. From this point on, the lower cam member 15 also effects compression of the inner coil spring 43. Accordingly, any further rotational movement of the lower cam member 15 requires compression of both springs 42, 43 and, accordingly, a greater force to open the door.

Should a user desire to open the door to a further position, the door is again moved in the clockwise direction (relative to FIG. 1) thereby causing the lobe edge 26 to ride on the inclined surface 34 onto the second flat surface 36 (see FIG. 5). In this position, the cam members 14, 15 are in the second dwell position. Such a position may occur at a point of rotation of 135° of the door relative to the frame. Continued pivoting of the door will cause no further axial movement of the cam member 15 within the housing 11 or compression of the springs 42, 43. Instead, the lobe edge 26 of the upper cam member 14 will simply ride along the flat surface 36 of the cam member 15.

Should the user desire to close the door, the door is simply swung in a counterclockwise manner towards the closing position. At this time, the lower cam member 15 rotates relative to the stationary cam member 14 so that the annular cam surface 28 slides over the lobe edge 26 until reaching the point indicated in FIGS. 1 and 3. During this time, the two coil springs 42, 43 effect a relatively strong closing force on the door, that is during sliding of the inclined surface 34 on the lobe edge 26. The force is reduced as the inclined surface 30 moves into engagement with the lobe edge 26.

Various modifications may be made in the hinge assembly without departing from the scope of the invention. For example, the first door position may be located at a point of rotation of 60° of the door relative to the frame. This may be desirable where there are a series of doors which are placed close to each other and full opening of the door is not desired. In addition, the second door position may typically follow the first door position by an angle of rotation of 30°. However, the distance between the two door positions may also vary depending upon the intended use of the door.

In another embodiment, the first door position may be eliminated. In this embodiment, the second spring simply begins to become compressed after the door has been opened a predetermined angle, for example 90°. Of course, any other suitable angle may be used.

While the first door position corresponds to the point at which the second spring begins to be compressed, such is not necessary. That is, the first door position and the point at which the second spring begins to compress may be located at different points of rotation of the door relative to the frame.

As noted above, the cam surfaces of the cam members 14, 15 are made symmetrical so that the hinge assembly 10 can be used at the top of a door or at the bottom of a door. For example, if used at the bottom of the door, the hinge assembly 10 is rotated 180° from the position shown in FIG. 1 so that the flange 12 is at the bottom of the hinge assembly 10 and the abutment means 44 is located at the top of the assembly 10.

The invention thus provides a self-closing hinge assembly of relatively simple construction. Further, invention provides a self-closing hinge assembly which permits a door to be opened into multiple dwell positions.

The abutment means allows the spring pressure of the spring loaded self-closing hinge assembly to be adjusted to a suitable point at the time of assembly. Also, if desired, the spring pressure may be adjusted by a user using a suitable tool to turn the threaded abutment means 44 if this is provided for upon assembly of the hinge assembly.

What is claimed is:

1. A hinge assembly comprising an elongated housing;

a first cam member disposed in said housing for rotation relative to said housing, said member having a pin extending from one end out of said housing and having a cam surface at an opposite end;

a second cam member disposed in said housing in fixed relation thereto for rotation therewith relative to said first cam member, said second cam member having a cam surface facing said cam surface of said first cam member;

a first spring means in said housing located between one end of said housing and said second cam member and biasing said second cam member against said first cam member to mutually engage said cam surfaces with each other;

abutment means in said housing at said one end abutting said first spring means; and a second spring means in said housing coaxially within said first spring means, said second spring means being disposed against said abutment means at one end and being spaced from said second cam member at an opposite end to effect biasing of said second cam member against said first cam member after a predetermined compression of said first spring means.

2. A hinge assembly as set forth in claim 1 wherein said predetermined compression of said first spring means corresponds to an angle of rotation of 90° between said housing and said first cam member.

3. A hinge assembly as set forth in claim 1 wherein each said spring means is a coil spring.

4. A hinge assembly as set forth in claim 1 wherein said cam surface of said first cam member has a lobe defining an edge and said second cam member has an annular shape with a first point to receive said edge of said first cam member in a closed position of said cam members, a first inclined portion extending from said first point, a first flat horizontal portion corresponding to a first dwell position of said cam members relative to each other, a second inclined portion extending from said first flat horizontal portion and a second flat horizontal portion extending from said second inclined portion and corresponding to a second dwell position of said cam surfaces relative to each other.

5. A hinge assembly as set forth in claim 4 wherein said first flat horizontal potion is arcuately spaced from said first point a distance in a range of from 60° to 95°.

6. A hinge assembly as set forth in claim 5 wherein said second flat horizontal portion is arcuately spaced from said first point a distance in a range of from 90° to 135°.

7. A hinge assembly as set forth in claim 4 wherein said annular cam surface is symmetric relative to said first point.

8. A hinge assembly as set forth in claim 7 wherein said cam surface of said first cam member is movable relative to and along said cam surface of said second cam member to effect biasing of said second cam member against said first spring.

9. A hinge assembly as set forth in claim 1 wherein said abutment means is movable longitudinally of said housing to permit adjustment of said first spring means to a desired initial compression.

10. A hinge assembly as set forth in claim 9 wherein said abutment means is threaded into said housing.

11. A hinge assembly as set forth in claim 1 wherein said abutment means includes a guide pin extending coaxially within said second coil spring.

12. A hinge assembly as set forth in claim 11 wherein said pin of said first cam member extends coaxially through said second cam member and has a recess at one end thereof slidably receiving one end of said guide pin.

13. A hinge assembly as set forth in claim 12 which further comprises a washer slidably mounted on said guide pin between said second spring means and said pin of said first cam member.

14. A hinge assembly as set forth in claim 1 further comprising a bracket fixedly secured to said pin of said first cam for securement to a stationary frame.

15. A hinge assembly as set forth in claim 1 wherein said elongated housing has a rectangular cross-section.

16. A hinge assembly as set forth in claim 15 wherein said second cam member includes a mounting portion having a periphery of rectangular shape slidably mounted in said housing.

17. A hinge assembly as set forth in claim 15 wherein said second cam member includes a mounting portion having a plurality of radial projections slidably mounted in said housing to prevent relative rotation between said second cam member and said housing.

18. A hinge assembly comprising an elongated housing;

a first cam member disposed in said housing for rotation relative to said housing, said member having a pin extending from one end out of said housing and having a cam surface at an opposite end with a lobe defining an edge;

a second cam member disposed in said housing in fixed relation thereto for rotation therewith relative to said first cam member, said second cam member having a cam surface facing said cam surface of said first cam member, said cam surface of said second cam member having an annular shape with a first point to receive said edge in a closed position of said cam members relative to each other, a first inclined portion extending from said first point, a first flat portion corresponding to a first dwell position of said cam members relative to each other, a second inclined portion extending from said first flat portion and a second flat portion extending from said second inclined portion and corresponding to a second dwell position of said cam surfaces relative to each other; and spring means in said housing located between one end of said housing and said second cam member and biasing said second cam member against said first cam member to mutually engage said cam surfaces with each other;

abutment means in said housing at said one end of said housing abutting said spring means.

19. A hinge assembly as set forth in claim 18 wherein said first flat portion is arcuately spaced from said first point a distance in a range of from 60° to 95°.

20. A hinge assembly as set forth in claim 19 wherein said second flat portion is arcuately spaced from said first point a distance in a range of from 90° to 135°.

21. A hinge assembly as set forth in claim 18 wherein said abutment means is movable longitudinally of said housing.

22. a hinge assembly as set forth in claim 18 wherein said housing has a rectangular cross-section and wherein said second cam member includes a mounting portion having a periphery of rectangular shape slidably mounted in said housing.

23. A hinge assembly as set forth in claim 18 wherein said housing has a rectangular cross-section and wherein said second cam member includes a mounting portion having a plurality of radial projections slidably mounted in said housing to prevent relative rotation between said second cam member and said housing.

24. A hinge assembly as set forth in claim 18 wherein said spring means is a coil spring.

* * * * *

UNITED STATES PATENT AND TRADEMARK OFFICE

CERTIFICATE OF CORRECTION

PATENT NO. : 5,682,644

DATED : Nov. 4, 1997

INVENTOR(S) : Richard Bohacik and Bernard Parisi

It is certified that error appears in the above-identified patent and that said Letters Patent is hereby corrected as shown below:

Column 1, line 64, change "aim" to -also-

Signed and Sealed this

Twenty-seventh Day of January, 1998

Bruce Lehman

*Attest:*

BRUCE LEHMAN

*Attesting Officer*

*Commissioner of Patents and Trademarks*